US006968860B1

(12) United States Patent
Haenlein et al.

(10) Patent No.: US 6,968,860 B1
(45) Date of Patent: Nov. 29, 2005

(54) RESTRICTED FLOW HANDS-FREE FAUCET

(75) Inventors: Hans-Christoph Haenlein, San Jose, CA (US); Robert P. Arko, Palo Alto, CA (US); Karen L. Tsuei, Redwood City, CA (US)

(73) Assignee: Masco Corporation of Indiana, Indianapolis, IN (US)

( * ) Notice: Subject to any disclaimer, the term of this patent is extended or adjusted under 35 U.S.C. 154(b) by 0 days.

(21) Appl. No.: 10/912,254

(22) Filed: Aug. 5, 2004

(51) Int. Cl.[7] ..... F16K 31/02

(52) U.S. Cl. ..... 137/613; 137/801; 137/599.03; 137/601.14; 137/601.19; 251/129.04; 4/623

(58) Field of Search ..... 137/613, 801, 137/599.01, 599.03, 599.08, 601.14, 601.18, 137/601.19; 251/129.04; 4/623

(56) References Cited

U.S. PATENT DOCUMENTS

| | | | | |
|---|---|---|---|---|
| 3,724,001 | A | | 4/1973 | Ichimori et al. |
| 3,799,198 | A | | 3/1974 | Kijimoto |
| 4,127,085 | A | | 11/1978 | Katz et al. |
| 4,141,383 | A | | 2/1979 | Geimer |
| 4,213,197 | A | | 7/1980 | Magori |
| 4,222,410 | A | | 9/1980 | Geimer |
| 4,533,451 | A | | 8/1985 | Kumazawa |
| 4,604,764 | A | * | 8/1986 | Enzo ..... 4/623 |
| 4,709,728 | A | * | 12/1987 | Ying-Chung ..... 137/599.03 |
| 4,762,273 | A | | 8/1988 | Gregory et al. |
| 4,885,081 | A | | 12/1989 | Oliver |
| 4,892,286 | A | | 1/1990 | Reinicke et al. |
| 4,894,874 | A | | 1/1990 | Wilson |
| 4,941,219 | A | | 7/1990 | Van Marcke |
| 4,962,790 | A | | 10/1990 | Chou et al. |
| 5,050,641 | A | | 9/1991 | Shwu-Fen |
| 5,062,164 | A | | 11/1991 | Lee et al. |
| 5,072,859 | A | | 12/1991 | Wiley et al. |
| 5,092,560 | A | | 3/1992 | Chen |
| 5,095,945 | A | | 3/1992 | Jensen |
| 5,147,533 | A | | 9/1992 | Lipshultz et al. |
| 5,199,118 | A | | 4/1993 | Cole et al. |
| 5,226,629 | A | | 7/1993 | Millman et al. |
| 5,230,109 | A | | 7/1993 | Zaccai et al. |
| 5,254,243 | A | | 10/1993 | Carr et al. |
| 5,322,086 | A | | 6/1994 | Sullivan |
| D349,327 | S | | 8/1994 | Bonnell |
| 5,358,213 | A | | 10/1994 | Pilolla |
| 5,397,099 | A | | 3/1995 | Pilolla |
| 5,504,950 | A | | 4/1996 | Natalizia et al. |
| 5,549,010 | A | | 8/1996 | Park et al. |
| 5,549,487 | A | | 8/1996 | Nortier |
| 5,555,907 | A | | 9/1996 | Philipp |

(Continued)

FOREIGN PATENT DOCUMENTS

| | | |
|---|---|---|
| EP | 0 528 983 B1 | 11/1994 |

(Continued)

*Primary Examiner*—Kevin Lee
(74) *Attorney, Agent, or Firm*—Woodard, Emhardt, Moriarty, McNett & Henry LLP

(57) ABSTRACT

A faucet comprising a spout, a passageway, an electrically operable valve; a first manual valve; a first manual handle; and a bypass. The passageway conducts water flow through the spout. The electrically operable valve is disposed within the passageway. The first manual valve disposed within the passageway in series with the electrically operable valve. The first manual handle that controls the first manual valve. The bypass has a first end above the electrically operable valve, relative to the water flow, and a second end below the electrically operable valve, such that a portion of the water flow bypasses the electrically operable valve.

15 Claims, 2 Drawing Sheets

U.S. PATENT DOCUMENTS

| | | | |
|---|---|---|---|
| 5,555,912 | A | 9/1996 | Saadi et al. |
| 5,566,702 | A | 10/1996 | Philipp |
| 5,570,869 | A | 11/1996 | Diaz et al. |
| 5,577,660 | A | 11/1996 | Hansen |
| 5,595,216 | A | 1/1997 | Pilolla |
| 5,676,376 | A | 10/1997 | Valley |
| 5,714,066 | A | 2/1998 | Jang |
| 5,725,025 | A | 3/1998 | Park et al. |
| 5,730,165 | A | 3/1998 | Philipp |
| 5,868,311 | A | 2/1999 | Cretu-Petra |
| 5,915,417 | A | 6/1999 | Diaz et al. |
| 5,961,095 | A | 10/1999 | Schrott |
| 6,003,170 | A | 12/1999 | Humpert et al. |
| 6,024,867 | A | 2/2000 | Parise |
| 6,053,472 | A | 4/2000 | DeLand |
| 6,059,192 | A | 5/2000 | Zosimadis |
| 6,104,302 | A | 8/2000 | Vuong |
| 6,155,654 | A | 12/2000 | Oyama |
| 6,179,268 | B1 | 1/2001 | Seid |
| 6,202,980 | B1 | 3/2001 | Vincent et al. |
| 6,273,394 | B1 | 8/2001 | Vincent et al. |
| 6,294,786 | B1 | 9/2001 | Marcichow et al. |
| 6,315,208 | B1 | 11/2001 | Doyle |
| 6,317,717 | B1 | 11/2001 | Lindsey et al. |
| 6,363,549 | B2 | 4/2002 | Humpert et al. |
| RE37,888 | E | 10/2002 | Cretu-Petra |
| 6,481,634 | B1 | 11/2002 | Zosimadis |
| 6,513,787 | B1 | 2/2003 | Jeromson et al. |
| 6,619,320 | B2 | 9/2003 | Parsons |
| 6,734,685 | B2 | 5/2004 | Rudrich |
| 2002/0145527 | A1 | 10/2002 | Lassota |
| 2003/0102037 | A1 | 6/2003 | Parsons |

FOREIGN PATENT DOCUMENTS

| | | |
|---|---|---|
| EP | 1 019 791 B1 | 6/2002 |
| WO | WO 91/17949 | 11/1991 |
| WO | WO 94/00645 | 1/1994 |
| WO | WO 99/12084 | 3/1999 |
| WO | WO 99/34065 | 7/1999 |
| WO | WO 99/57381 | 11/1999 |
| WO | WO 01/20204 A1 | 3/2001 |
| WO | WO 01/27019 A1 | 4/2001 |
| WO | WO 02/076875 A2 | 10/2002 |

* cited by examiner

RESTRICTED FLOW HANDS-FREE FAUCET

BACKGROUND

1. Field of the Invention

The present invention relates generally to the field of automatic faucets. More particularly, the present invention relates to an automatic faucet having a restricted flow state.

2. Description of the Related Art

Automatic faucets have become popular for a variety of reasons. They save water, because water can be run only when needed. For example, with a conventional sink faucet, when a user washes their hands the user tends to turn on the water and let it run continuously, rather than turning the water on to wet their hands, turning it off to lather, then turning it back on to rinse. In public bathrooms the ability to shut off the water when the user has departed can both save water and help prevent vandalism.

One early version of an automatic faucet was simply a spring-controlled faucet, which returned to the "off" position either immediately, or shortly after, the handle was released. The former were unsatisfactory because a user could only wash one hand at a time, while the latter proved to be mechanically unreliable.

One solution was the hands-free faucet. These faucets employed a proximity detector and an electric power source to activate water flow without the need for a handle. In addition to helping to conserve water and prevent vandalism, hands-free faucets had additional advantages, some of which began to make them popular in homes, as well as public bathrooms. For example, there is no need to touch the faucet to activate it; with a conventional faucet, a user with dirty hands may need to wash the faucet after washing their hands. In public facilities non-contact operation is more sanitary. Hands-free faucets also provide superior accessibility for the disabled, the elderly, and those who need assisted care.

Other kinds of automatic faucets employ touch-control, in which water flow can be toggled by tapping a part of the faucet, such as a button or the spout.

Because one function of automatic faucets is to save water by shutting off the water flow when it is not immediately needed (without requiring the user to manually turn it off and then on again), it is possible for the user to become confused about the state of the faucet. With a strictly manual faucet, the user uses the presence or absence of a water stream to determine whether the faucet is on. With an automatic faucet, however, the absence of a water stream does not indicate whether the faucet has been manually closed, or whether the electrically operable valve is closed and the manual valve is open.

This uncertainty can have several undesirable effects. For example, it can result in inadvertent activation of water flow, as one may approach or put items in the sink area for certain activities when water flow is not desired. This can be especially problematic with faucets that have a proximity sensor, since water flow can be initiated when the user places a hand or other object in the path of the proximity sensor. Also, in certain applications conservation of power is desirable, making it desirable to turn off the automatic faucet functions. In these applications a user may forget or overlook the fact that the faucet is still in an automatic operation mode due to the absence of water flow. Most of these problems can be especially problematic for users unfamiliar with the automatic faucet's operation, such as visitors, or even new adopters.

Thus, what is needed is an automatic faucet that provides users conspicuous and intuitively obvious feedback to distinguish between a manual off state and an automatic off state. The present invention is directed towards meeting these needs, among others.

SUMMARY OF THE INVENTION

In a first embodiment, a faucet according to the present invention comprises: a spout; a passageway; an electrically operable valve; a first manual valve; a first manual handle; and a bypass. The passageway conducts water flow through the spout. The electrically operable valve is disposed within the passageway. The first manual valve disposed within the passageway in series with the electrically operable valve. The first manual handle that controls the first manual valve. The bypass has a first end above the electrically operable valve, relative to the water flow, and a second end below the electrically operable valve, such that a portion of the water flow bypasses the electrically operable valve.

In a second embodiment, a faucet according to the present invention comprises: a spout; a passageway; an electrically operable valve; a bypass; a manual valve; a manual handle; a touch-control; a proximity sensor; and a logical control. The passageway conducts water flow through the spout. The electrically operable valve is disposed within the passageway, and has an opened position, in which water is free to flow through the passageway, and a closed position, in which the passageway is blocked. The bypass has a first end above the electrically operable valve, relative to the water flow, and a second end below the electrically operable valve, such that a portion of the water flow bypasses the electrically operable valve. The manual valve is disposed within the passageway in series with the electrically operable valve. The manual handle controls the manual valve. The touch-control generates a first output signal while the touch-control is in contact with a user. The proximity sensor generates a second output signal when an object is detected within a detection zone of the proximity sensor. The logical control toggles the electrically operable valve in response to either of the first output signal and the second output signal.

In a third embodiment, a faucet according to the present invention comprises: a spout; a passageway; an electrically operable valve; and a sensor. The passageway conducts water flow through the spout. The electrically operable valve is disposed within the passageway, and has at least an open position and a closed position. The electrically operable valve makes an incomplete seal with the passageway in the closed position. The sensor is operably connected to the electrically operable valve via a logical control, the logical control generating a control signal when the sensor observes an activation event. The electrically operable valve actuates in response to the control signal.

In a fourth embodiment, a faucet according to the present invention comprises: a spout; a passageway; an electrically operable valve; a bypass; and a sensor. The passageway conducts water flow through the spout. The electrically operable valve is disposed within the passageway, and has at least an open position and a closed position. The bypass has a first end above the electrically operable valve, relative to the water flow, and a second end below the electrically operable valve, such that a portion of the water flow bypasses the electrically operable valve. The sensor is operably connected to the electrically operable valve via a logical control, the logical control generating a control signal when the sensor observes an activation event. The electrically operable valve actuates in response to the control signal.

In a fifth embodiment, an automatic faucet has a "manual on " state, in which volume and temperature of water flow is controlled by at least one manual valve; an "off" state, in which water flow is halted; and a "conserve" state, in which water flow volume is restricted by an electrically operable valve.

BRIEF DESCRIPTION OF THE DRAWINGS

Although the characteristic features of this invention will be particularly pointed out in the claims, the invention itself, and the manner in which it may be made and used, may be better understood by referring to the following descriptions taken in connection with the accompanying figures forming a part hereof.

DETAILED DESCRIPTION OF THE PREFERRED EMBODIMENT

For the purposes of promoting an understanding of the principles of the invention, reference will now be made to the preferred embodiment and specific language will be used to describe the same. It will nevertheless be understood that no limitation of the scope of the invention is thereby intended. Such alternations to and further modifications of the invention, and such further applications of the principles of the invention as described herein as would normally occur to one skilled in the art to which the invention pertains, are contemplated, and desired to be protected.

A preferred embodiment automatic faucet according to the present invention provides conspicuous and intuitively obvious visual feedback that alerts even users unfamiliar with the operation of automatic faucets when the faucet is in an automatic off state, rather than a manual off (shut down) state. In the preferred embodiment, an automatic faucet according to the present invention uses a third, restricted flow (or "conserve") state in the automatic off mode. In the restricted flow state a thin stream of water passes through the spout. This thin stream uses a negligible amount of water, but is an unmistakable indication to the user that the faucet has not been manually shut off—even if the user is otherwise unfamiliar with the operation of automatic faucets.

Figure 2:
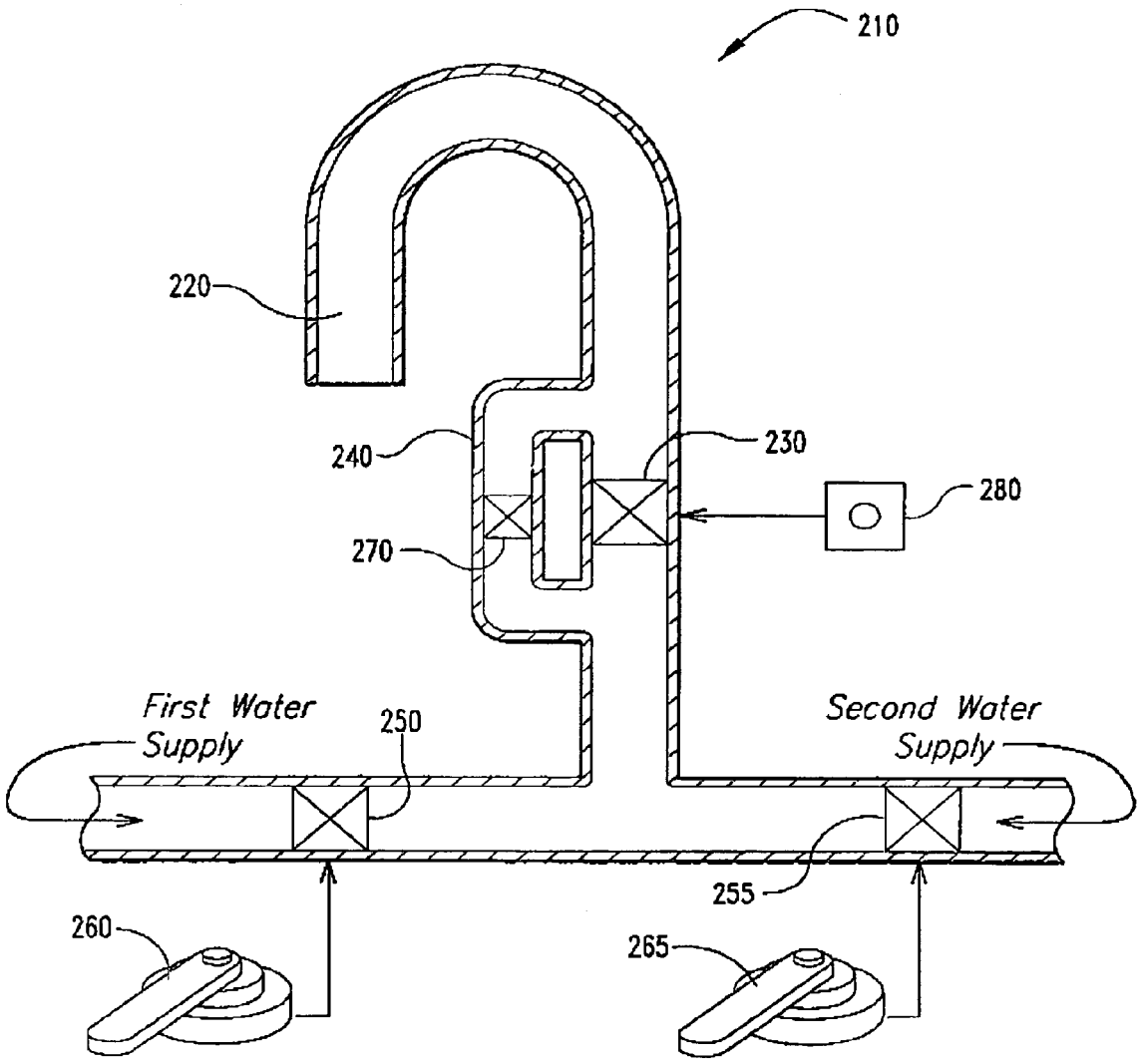
FIG. 2 is a schematic diagram of an automatic faucet according to one embodiment of the present invention.

A preferred embodiment faucet 210 according to the present invention is shown in FIG. 2, and comprises a manually controlled valve 250 in series with an electrically operable valve, such as a magnetically latching solenoid valve 230. Thus, when the solenoid valve 230 is opened the faucet can be operated in a conventional manner, in a manual control mode. Conversely, when the manually controlled valve 250 is set to select a water temperature and flow rate of water through spout 220, the solenoid valve 230 can be touch controlled, activated by proximity sensors 280 when an object (such as a user's hand) is within a detection zone, or otherwise controlled to toggle water flow.

Magnetically latching solenoids comprise at least one permanent magnet. When the armature is unseated, it is sufficiently distant from the'at least one permanent magnet that it applies little force to the armature. However, when a pulse of power is applied to the solenoid coil the armature is moved to the latched position, sufficiently close to the at least one permanent magnet that the armature is held in place. The armature remains seated in the latched position until a pulse of power is applied to the solenoid coil that generates a relatively strong opposing magnetic field, which neutralizes the latching magnetic field and allows a spring to drive the armature back to the unlatched position. Thus, a magnetically latching solenoid, unlike typical solenoids, does not require power to hold the armature in either position, but does require power to actuate the armature in both directions. Magnetically latching solenoid valves are therefore advantageous, because they use less power. Nevertheless, it will be appreciated that any suitable electrically operable valve can be used in series with the manual valve. For example, any type of solenoid valve can be used.

In certain embodiments, a faucet according to the present invention includes more than one manual valve. For example, as with many conventional faucets (especially lavatory-type faucets), FIG. 2 shows separate handles 260, 265, which each control a manual valve (250, 255) for a hot (first) water supply and a cold (second) water supply, respectively.

Figure 1:
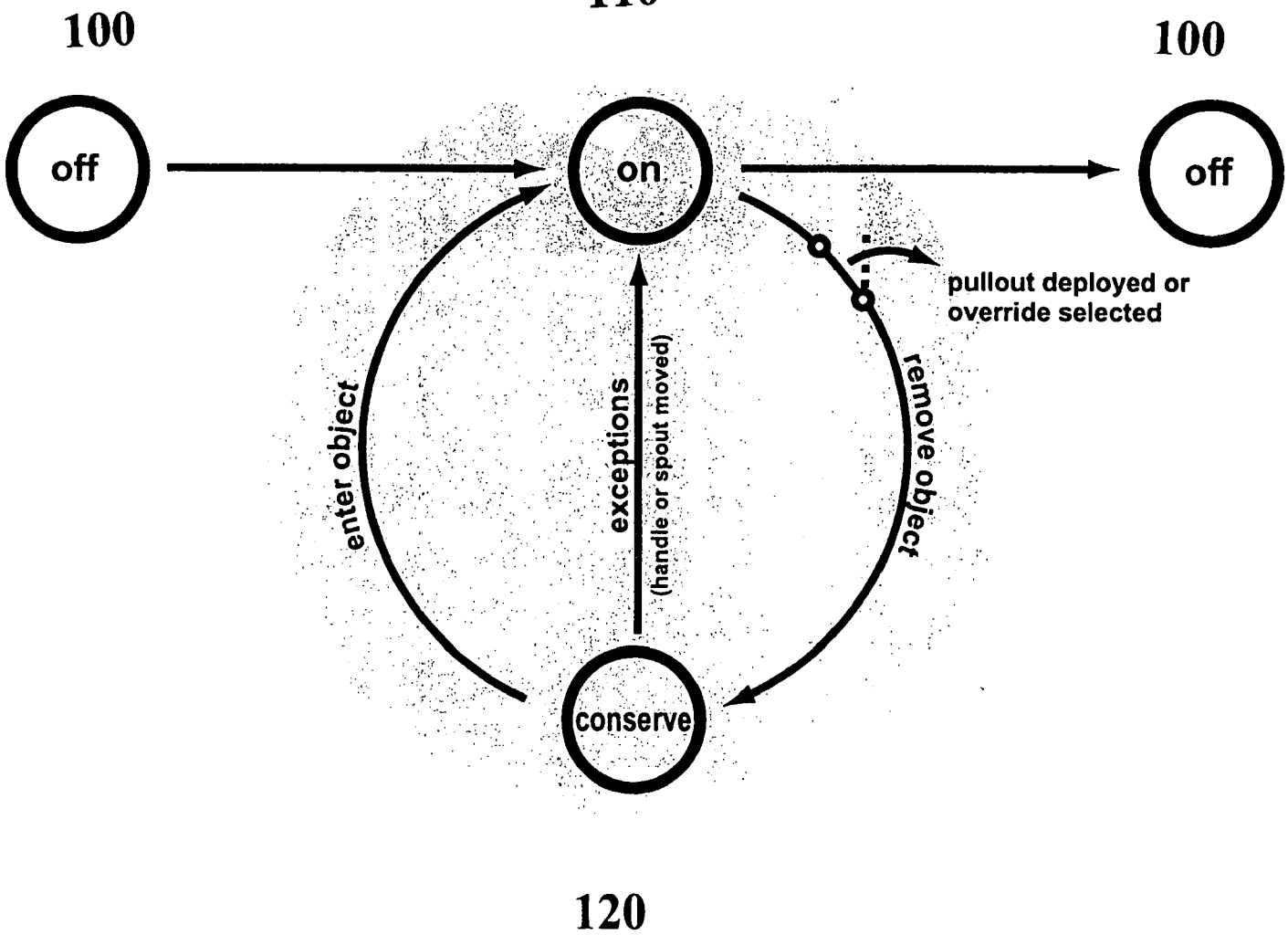
FIG. 1 is a state diagram of an automatic faucet having a restricted flow state according to the present invention.

FIG. 1 is a state diagram illustrating the operation of an automatic faucet according to the present invention. In the faucet's rest, or "off" state, indicated as 100 in FIG. 1, the manual valve is closed. The control system may be inactive, or in a low power-consumption state. For example, the frequency at which proximity sensors scan their detection zones may be relatively low. When the faucet is activated, it moves to the active, or "on" state, indicated as 110 in FIG. 1. In this state, water flows at a rate and temperature that is controlled by the manual valve.

Preferably, the manual valve is controlled with a manual handle, with controls that mimic a conventional faucet. For example, in many kitchen-type faucets, a single manual handle controls both the volume and temperature of the water flow. Typically, the temperature is controlled by the angular position of the handle (about the vertical axis), while the volume is controlled by the elevation of the handle (relative to the horizontal plane). In certain embodiments, separate manual valves control a hot water supply and a cold water supply, with each valve being actuated by rotation of a handle. In these embodiments, both the volume and the temperature of water flow are controlled by the relative positions of the two handles. It will be appreciated that, in some faucets, the manual handles are actually knobs—especially in those embodiments employing more than one manual valve.

While in the "on" state 110, the automatic faucet can be toggled into "conserve" mode 120. In certain embodiments the automatic faucet includes one or more proximity sensors that signal the faucet to move between the "on" state 110 and the "conserve" state 120. For example, in certain embodiments the automatic faucet moves to the "conserve" state 120 whenever there is no object observed in the proximity sensor's detection zone. In certain other embodiments, the automatic faucet includes one or more touch sensors. For example, in certain embodiments, the automatic faucet can be toggled between the "on" state 110 and the "conserve" state 120 by tapping the faucet spout, or by pushing a button.

In the preferred embodiment, the automatic faucet is toggled from the "conserve" state 120 to the "on" state 110 whenever the manual handle is adjusted. In those embodiments including a touch sensor in the faucet's spout, the automatic faucet is also preferably toggled to the "on" state 110 when the spout is moved.

The automatic faucet is preferably returned to the "off" state 100 when the manual valve is closed.

The restricted flow state 120 is especially useful in conjunction with certain applications of proximity sensors. Pending U.S. patent application Ser. No. 10/755,582 (which is hereby incorporated by reference in its entirety) teaches the use of a proximity sensor with a detection zone aligned along the water stream from the faucet spout. In such a faucet, a restricted flow state provides a visual indication of the location of the detection zone, indicating the positions at which a hand or other object can be introduced to activate unrestricted water flow.

The restricted flow state can be effected in at least two different ways. In certain embodiments, the restricted flow state is achieved by using an electrically operable valve that does not make a complete seal. For example, the electrically operable valve can have an aperture. Alternatively, the form of its perimeter can deviate from the form of the flow passageway at its seated position, such that water can pass between the edge of the valve and the wall of the flow passageway. In this way, even when the electrically operable valve is seated, a limited amount of water flows through the electrically operable valve.

Preferably, as shown in FIG. 2, the restricted flow state is achieved by providing a bypass passageway 240 in parallel with the electrically operable valve 230. Because this permits the use of off-the-shelf valves, it reduces manufacturing costs. Furthermore, an independent choke 270 can be included in the bypass 240, to regulate the amount the volume of the restricted flow through bypass 240.

It has been determined by the inventors that the volume of water flow in the restricted flow state is ideally slightly greater than the amount necessary to maintain approximately laminar flow. Lesser flow rates can be overlooked or misinterpreted by users unfamiliar with the operation of automatic faucets. On the other hand, greater flow volume serves no purpose, and therefore is an unnecessary waste of water. Since the volume of flow necessary to sustain laminar flow can vary with a number of parameters (including, for example, water pressure, and atmospheric pressure), it can be useful for a user to be able to adjust the volume of flow in the restricted flow state.

The restricted flow state of the present invention can advantageously be employed in conjunction with most automatic faucets. In particular, automatic faucets described in pending U.S. patent application Ser. Nos. 10/755,581; 10/755,582; and 10/757,316 (which are each incorporated by reference herein in their entireties) can include a restricted flow state according to the present invention.

Another advantage of the restricted flow state 120 is that it provides inexpensive and useful feedback to the faucet's control system. In conventional automatic faucets, water flow is halted by closing either the manual valve or the electrically operable valve. Consequently, for the control system to recognize when it is not in use, it must be inferred from multiple sensors. For example, pending U.S. patent application Ser. No. 10/755,581 (which is hereby incorporated by reference in its entirety) teaches a method that requires tracking the position of the electrically operable valve, in conjunction with tracking water flow using a flow sensor. In an automatic faucet according to the present invention, the flow sensor alone (such as the FS-3 Series manufactured and sold by Gems Sensors) is sufficient for the control system to detect when the faucet is in use. As long as the manually operable valve is open, water will be flowing (in either the restricted flow state, or the unrestricted flow state), regardless of the position of the electrically operable valve.

While the invention has been illustrated and described in detail in the drawings and foregoing description, the description is to be considered as illustrative and not restrictive in character. Only the preferred embodiments, and such alternative embodiments deemed helpful in further illuminating the preferred embodiment, have been shown and described. It will be appreciated that changes and modifications to the foregoing can be made without departing from the scope of the following claims.

What is claimed is:

1. A faucet comprising:

a spout;

a passageway that conducts water flow through the spout;

a electrically operable valve disposed within the passageway;

a first manual valve disposed within the passageway in series with the electrically operable valve;

a first manual handle that controls the first manual valve; and a bypass, the bypass having a first end above the electrically operable valve, relative to the water flow, and a second end below the electrically operable valve, such that a portion of the water flow bypasses the electrically operable valve.

2. The faucet of claim 1, further comprising a choke disposed within the bypass, such that the amount of the water flow bypassing the electrically operable valve is adjustable by actuation of the choke.

3. The faucet of claim 1, wherein the first manual handle is a knob.

4. The faucet of claim 1, further comprising:

a second manual valve disposed within the passageway, in series with the electrically operable valve, and in parallel with the first manual valve; and a second manual handle that controls the second manual valve;

wherein the first manual valve and the second manual valve control water flow from a first water supply and a second water supply, respectively.

5. The faucet of claim 4, wherein the first water supply supplies water having a different temperature from the water supplied by the second water supply.

6. The faucet of claim 1, further comprising a proximity sensor that is sensitive to presence of objects within a detection zone of the proximity sensor.

7. The faucet of claim 6, wherein the faucet has:

a manual mode, wherein the proximity sensor is inactive; and a hands-free mode, wherein water flow is toggled on and off in response to the proximity sensor.

8. The faucet of claim 1, further comprising a capacitive touch control that toggles operates the electrically operable valve.

9. The faucet of claim 1, further comprising:

a sensor operably connected to the electrically operable valve via a logical control, the logical control generating a control signal when the sensor observes an activation event; and wherein the electrically operable valve actuates in response to the control signal.

10. The faucet of claim 9, wherein the sensor is a proximity sensor.

11. The faucet of claim 1, having a first state, in which volume and temperature of water flow though the passageway is controlled by the first manual valve, a second state, in which water flow though the passageway is halted, and a third state, in which the volume of water flow though the passageway is restricted by the electrically operable valve.

12. The faucet of claim 1, wherein the electrically operable valve at most partially seals the passageway, such that closing the electrically operable valve and opening the first manual valve provides a restricted flow state for the faucet.

13. The faucet of claim 1, further comprising:

a first control means for electrically operating the first valve; and a second control means for controlling the second valve.

14. The faucet of claim 13, wherein the first control means comprises a touch control.

15. The faucet of claim 13, wherein the first control means further comprises a proximity sensor.

* * * * *